US011629534B2

(12) United States Patent
Manly et al.

(10) Patent No.: US 11,629,534 B2
(45) Date of Patent: Apr. 18, 2023

(54) LATCH HAVING COVER

(71) Applicant: Southco, Inc., Concordville, PA (US)

(72) Inventors: Jonathan Edward Manly, Birmingham (GB); Andrew James Thornton, Worcester (GB); Jack Dennehy, Worcester (GB); Michael Post, Hilzingen (DE); Thomas V. Aukzemas, Lincoln University, PA (US)

(73) Assignee: Southco, Inc., Concordville, PA (US)

( * ) Notice: Subject to any disclaimer, the term of this patent is extended or adjusted under 35 U.S.C. 154(b) by 777 days.

(21) Appl. No.: 16/466,719

(22) PCT Filed: Dec. 7, 2017

(86) PCT No.: PCT/US2017/065038
§ 371 (c)(1),
(2) Date: Jun. 5, 2019

(87) PCT Pub. No.: WO2018/106876
PCT Pub. Date: Jun. 14, 2018

(65) Prior Publication Data

US 2019/0338569 A1 Nov. 7, 2019

Related U.S. Application Data

(60) Provisional application No. 62/431,677, filed on Dec. 8, 2016.

(51) Int. Cl.
*E05C 5/04* (2006.01)
*E05F 1/12* (2006.01)
(Continued)

(52) U.S. Cl.
CPC ..... *E05C 5/04* (2013.01); *E05B 17/142* (2013.01); *E05C 3/042* (2013.01); *E05F 1/1207* (2013.01); *E05Y 2900/20* (2013.01)

(58) Field of Classification Search
CPC ..... E05B 5/04; E05B 17/142; E05B 15/0053; E05B 17/0025; E05B 17/18;
(Continued)

(56) References Cited

U.S. PATENT DOCUMENTS 1,961,456 A 6/1934 Rubner
1,982,956 A 12/1934 Jacobi
(Continued)

FOREIGN PATENT DOCUMENTS

CN 204899450 U 12/2015
GB 2441891 A * 3/2008
(Continued)

OTHER PUBLICATIONS

Indian Examination Report for Indian Application No. 201917020989, dated Jun. 8, 2021 with translation, 6 pages.
(Continued)

*Primary Examiner* — Lloyd A Gall
(74) *Attorney, Agent, or Firm* — RatnerPrestia

(57) ABSTRACT

A latch is configured to fix a panel relative to a frame. The latch includes a housing having a longitudinal axis and defining an aperture along the longitudinal axis; a cap mounted within the aperture of the housing for rotation about the longitudinal axis, the cap comprising a drive surface; and a cover coupled to the housing to pivot about a lateral axis, the cover pivotable to be in a closed position in which the cover covers the cap; wherein when the cap is in an unlatched position, the drive surface of the cap is aligned with an engagement surface of the cover and positioned to block the cover from pivoting to the closed position; and wherein when the cap is in a latched position, the drive surface is unaligned with the engagement surface and positioned to permit the cover to pivot to the closed position.

19 Claims, 15 Drawing Sheets

(51) Int. Cl.
*E05B 17/20* (2006.01)
*E05B 17/14* (2006.01)
*E05C 3/04* (2006.01)

(58) Field of Classification Search
CPC .... E05B 17/2034; E05B 17/185; E05C 3/042; E05C 5/02; E05F 1/1207; Y10T 70/7955; Y10T 70/796; Y10T 70/7977; Y10T 70/7983; Y10T 70/8649; Y10T 70/5301; Y10T 70/5305; Y10T 70/531; Y10T 70/5314; Y10T 292/0863; Y10T 292/0864; Y10T 292/0886; Y10T 292/0887; Y10T 16/5384; Y10T 16/53845; Y10T 16/5387; Y10T 16/540255
See application file for complete search history.

(56) References Cited

U.S. PATENT DOCUMENTS 2,454,925 A 11/1948 Jacobi
2,782,625 A * 2/1957 Williams ..... E05B 17/183 70/370
3,916,657 A 11/1975 Steinbach
4,583,775 A * 4/1986 Bisbing ..... E05C 3/042 292/64
5,961,162 A 10/1999 Gläser et al.
2005/0132534 A1* 6/2005 Chen ..... H04M 1/0216 16/324
2005/0138771 A1* 6/2005 Su ..... H04M 1/0216 16/330
2007/0113379 A1* 5/2007 Lu ..... H04M 1/0216 16/319
2007/0245523 A1* 10/2007 Yang ..... H04M 1/0216 16/330
2009/0100641 A1* 4/2009 Yang ..... E05D 11/1078 16/303
2010/0162526 A1* 7/2010 Duan ..... H04M 1/0216 16/303
2011/0067203 A1* 3/2011 Duan ..... H04M 1/0216 16/303
2013/0205848 A1 8/2013 Langenberg et al.
2020/0048929 A1* 2/2020 Carabalona ..... E05B 17/0025

FOREIGN PATENT DOCUMENTS

KR 20050041477 A 5/2005
WO 2017011443 A1 1/2017

OTHER PUBLICATIONS

International Search Report and Written Opinion for International Application No. PCT/US2017/065038, dated Feb. 12, 2018—13 pages.
Chinese Office Action for Chinese Application No. 201780076126.9, dated Jul. 3, 2020, with translation, 21 pages.
International Preliminary Report on Patentability for International Application No. PCT/US2017/065038, dated Jun. 11, 2019, 11 pages.
European Communication pursuant to Article 94(3) for European Application No. 17 818 410.7, dated Jun. 29, 2020, 6 pages.
Brazilian Office Action for Brazilian Application No. 212019011047-5. dated Nov. 16, 2022 with translation, 17 pages.

* cited by examiner

FIG. 3A
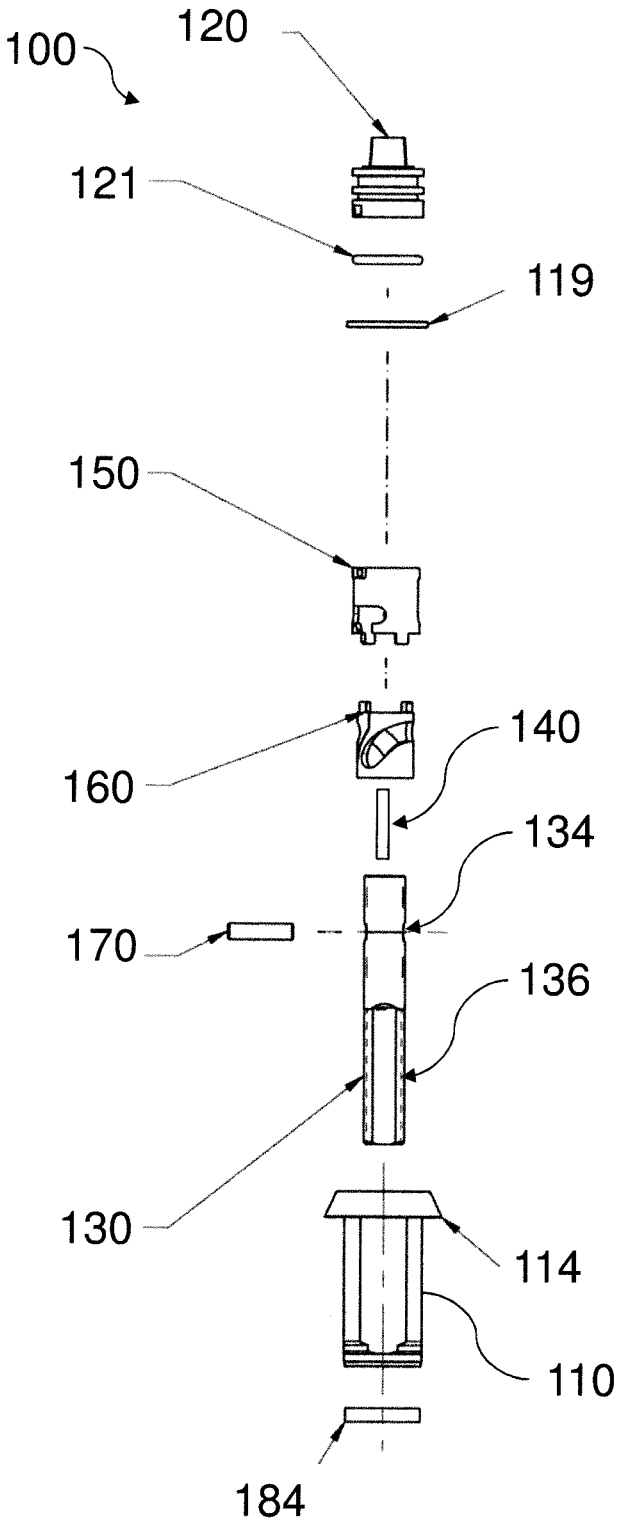
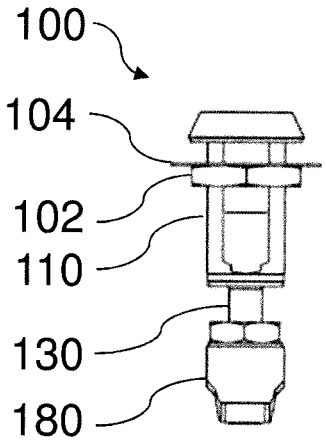
FIG. 3B

LATCH HAVING COVER

This patent application is a U.S. National Phase Patent Application of PCT Application No.: PCT/US2017/065038, filed Dec. 7, 2017, which claims priority to U.S. Provisional Application No. 62/431,677, entitled LATCH HAVING COVER, filed on 8 Dec. 2016, the contents of which are incorporated herein by reference in their entirety for all purposes.

FIELD OF THE INVENTION

The present invention relates generally to latches, and particularly, to compression latches that can be used for securing storage compartments and can provide a clear indication regarding the latched or unlatched state of the latches.

BACKGROUND OF THE INVENTION

Conventionally, storage compartments in restricted areas (such as commercial, rail, or medical environments for example) must be secured to prevent unauthorized access to their contents. Latches may be used to restrict access to such compartments to users having a corresponding key. In many latches, it may not be clearly visible to the user whether the latch is in an opened or closed position. For such latches, it may be advantageous to provide an indication regarding whether the latch is in a latched or unlatched state.

SUMMARY OF THE INVENTION

Aspects of the present invention are related to latches.

According to one aspect of the invention, a latch is configured to fix a panel relative to a frame. The latch includes a housing configured for engagement to the panel, the housing having a longitudinal axis and defining an aperture along the longitudinal axis; a cap mounted within the aperture of the housing for rotation about the longitudinal axis, the cap comprising a drive surface for rotating the cap relative to the housing between a latched position and an unlatched position; and a cover coupled to the housing to pivot about a lateral axis different from the longitudinal axis, the cover pivotable to be in a closed position in which the cover covers the cap, the cover comprising an engagement surface spaced from the lateral axis; wherein when the cap is in the unlatched position, the drive surface of the cap is aligned with the engagement surface of the cover and positioned to block the cover from pivoting to the closed position; and wherein when the cap is in the latched position, the drive surface of the cap is unaligned with the engagement surface of the cover and positioned to permit the cover to pivot to the closed position.

The cap can include a drive stud extending along the longitudinal axis and forming the drive surface, and the drive surface can include a recess defined in the drive stud. Also, the cap can define a drive opening extending in a direction along the longitudinal axis and forming at least a portion of the drive surface, and the drive surface can include a recess defined in a wall of the drive opening. The engagement surface can be defined by a protrusion extending from a surface of the cover facing the cap when the cover is in the closed position.

The latch can include a hinge extending along the lateral axis. The hinge can include a first cam fixed against rotation relative to the housing, a second cam fixed against rotation relative to the cover, and a spring biasing the first and second cams to contact one another. The first and second cams can each comprise first and second cam surfaces, wherein contact between the first cam surfaces generated by the spring biases the cover to rotate in a direction toward the closed position, and wherein contact between the second cam surfaces generated by the spring cases the cover to rotate in a direction away from the closed position.

The latch can also include a pawl coupled to the cap, the pawl being configured to engage the frame. Also, the latch can include a shaft extending along the longitudinal axis within the aperture of the housing, the shaft being mounted for rotation about the longitudinal axis, the shaft further being mounted for axial movement relative to the cap; a spring configured to bias the shaft away from the cap along the longitudinal axis; a sleeve interposed between the shaft and the housing, the sleeve defining a first slot; a cam interposed between the shaft and the housing, the cam being rotatable relative to the sleeve about the longitudinal axis, the cam defining a second slot; and a pin extending radially outwardly from the shaft relative to the longitudinal axis, the pin extending into the first and second slots, wherein the first and second slots are configured to guide the rotation and axial movement of the shaft as the cap is rotated within the housing such that the pawl engages or disengages the frame.

According to another aspect of the invention, a latch is configured to fix a panel relative to a frame, the latch including a housing configured for engagement to the panel, the housing having a longitudinal axis and defining an aperture along the longitudinal axis; a cap mounted within the aperture of the housing for rotation about the longitudinal axis, the cap comprising a drive stud for rotating the cap relative to the housing between a latched position and an unlatched position, a recess being defined in the drive stud; a base rigidly coupled to the housing; a lid coupled to the base to pivot about a lateral axis different from the longitudinal axis, the lid pivotable to be in a closed position in which the lid covers the cap, the lid comprising a protrusion extending from a surface of the cover facing the cap when the cover is in the closed position; and a hinge extending along the lateral axis and coupling the lid to the base, the hinge comprising a first cam fixed against rotation relative to the base, a second cam fixed against rotation relative to the lid, and a spring biasing the first and second cams to contact one another, wherein when the cap is in the unlatched position, the recess of the cap is unaligned with the protrusion of the lid and the drive stud is positioned to block the lid from pivoting to the closed position; and wherein when the cap is in the latched position, the recess of the cap is aligned with the protrusion of the lid and the drive stud positioned to permit the lid to pivot to the closed position.

The first and second cams can each comprise first and second cam surfaces, wherein contact between the first cam surfaces generated by the spring biases the lid to rotate in a direction toward the closed position, and wherein contact between the second cam surfaces generated by the spring cases the lid to rotate in a direction away from the closed position.

According to yet another aspect of the invention, a compartment includes a frame; a panel mounted for movement relative to the frame between opened and closed positions; and a latch coupled to the panel, the latch being positioned to fix the panel relative to the frame in the closed position, the latch including a housing engaged to the panel, the housing having a longitudinal axis and defining an aperture along the longitudinal axis; a cap mounted within the aperture of the housing for rotation about the longitudinal axis, the cap comprising a drive surface for rotating the cap relative to the housing between a latched position and an unlatched position; and a cover coupled to the housing to pivot about a lateral axis different from the longitudinal axis, the cover pivotable to be in a closed position in which the cover covers the cap, the cover comprising an engagement surface spaced from the lateral axis; wherein when the cap is in the unlatched position, the drive surface of the cap is aligned with the engagement surface of the cover and positioned to block the cover from pivoting to the closed position; and wherein when the cap is in the latched position, the drive surface of the cap is unaligned with the engagement surface of the cover and positioned to permit the cover to pivot to the closed position.

The housing can define a recess extending radially outwardly from the longitudinal axis of the housing and the cover includes a housing engagement surface positioned to extend into the recess when the cover is in the closed position, and the housing engagement surface can extend from the engagement surface. Also, the engagement surface and the housing engagement surface can inhibit relative rotation of the cap and the housing when the cover is in the closed position. The latch can also include a base fixed against rotation relative to the housing, the cover being pivotally connected to the base. Additionally, the latch can include a recess defined on the cover or on the base for engagement with a protrusion on the base or on the cover, the recess and the protrusion being positioned to resist rotation of the cover relative to the housing when the cover is in the closed position, and the recess can be defined on the cover and the protrusion can be on the base.

BRIEF DESCRIPTION OF THE DRAWINGS

The invention is best understood from the following detailed description when read in connection with the accompanying drawings. It is emphasized that, according to common practice, the various features of the drawings are not to scale. On the contrary, the dimensions of the various features may be arbitrarily expanded or reduced for clarity. Included in the drawings are the following figures:

FIG. 3A depicts an exploded view of the latch of FIG. 1;

FIG. 3B depicts a side view of the latch of FIG. 1;

DETAILED DESCRIPTION OF THE INVENTION

Although the invention is illustrated and described herein with reference to specific embodiments, the invention is not intended to be limited to the details shown. Rather, various modifications may be made in the details within the scope and range of equivalents of the claims and without departing from the invention.

The exemplary latches described herein may have a lower profile than conventional latches for storage compartments in that they can provide for a reduction of the degree of the protrusion of the latch into such compartments, decreasing or eliminating the effect of the latch on available storage space. These embodiments generally incorporate a latch cap and shaft which rotatably and/or axially move to open or close the compartment.

The exemplary latches described herein may also be capable of providing a clear indication regarding whether the latch is in a latched or unlatched state. These latches may employ a cover that functions both to provide the indication and protect internal features of the latch from moisture or dirt present in an external environment of the latch. This indication may be helpful to prevent accidental or unintentional removal of a latch key before the latch is completely latched or unlatched.

In examples set forth below, the latch cover cannot be fully closed until the latch is in the latched position. Preventing the cover from closing may serve as a reminder to lock compartments, and may promote a methodical opening and closing sequence of latches. During the unlatching sequence, the cap of the latch rotates out of alignment with an engagement structure on the latch cover. As a result, when in an unlatched position, it is not possible to close the cover. The sequence is reversed in the latching operation, allowing the cover to be closed only when the cap has returned to the latched position.

While particular latch embodiments are described herein, components of the disclosed embodiments may be incorporated into any conventional latches known to one of ordinary skill in the art to achieve the advantages described herein. For example, components of the disclosed embodiments may be incorporated into those latches described in PCT International Application No. PCT/US2016/041873 and/or U.S. Patent Application No. 62/413,080, the contents of each of which are incorporated herein by reference in their entireties. Likewise, the disclosed latches may be usable on any structure, including any type of storage compartments in which it is desirable to secure the contents of the compartment. The latch is preferably a compression latch for use with a panel mounted to a frame. Such a compression latch is configured for movement from an open position in which a panel is not latched relative to the frame, to a latched position in which the panel is latched relative to the frame, and to a locked position in which the panel is pulled against the frame such that they are compressed against one another.

Figure 7A:
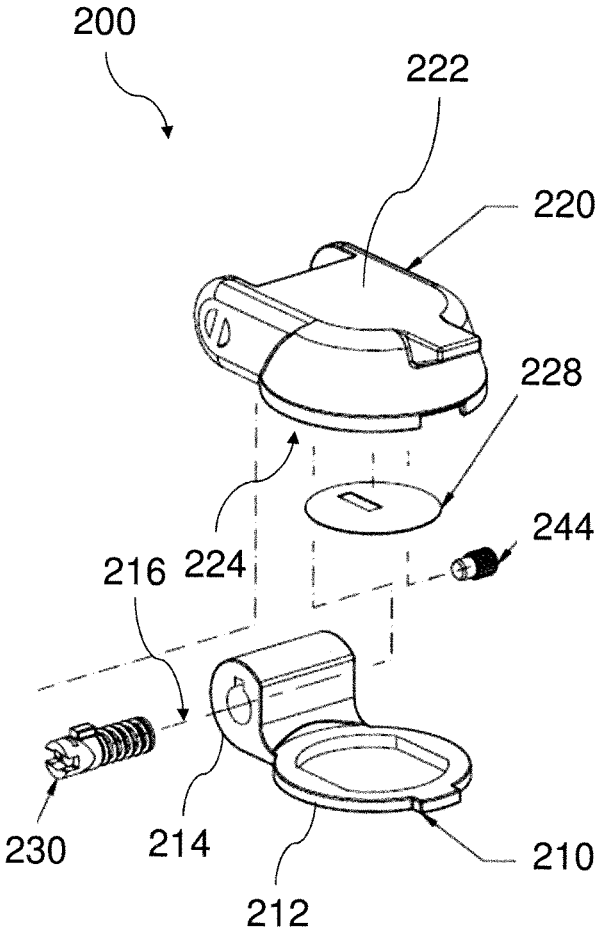
FIGS. 7A-7C depict an exemplary cover of the latch of FIGS. 2A and 2B.
Figure 7B:
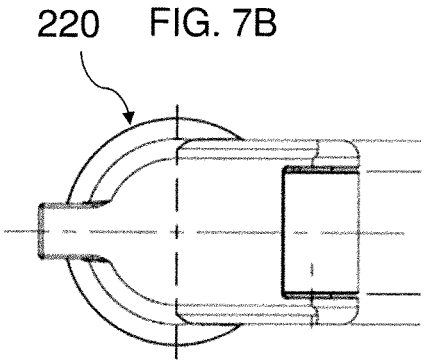
Figure 7C:
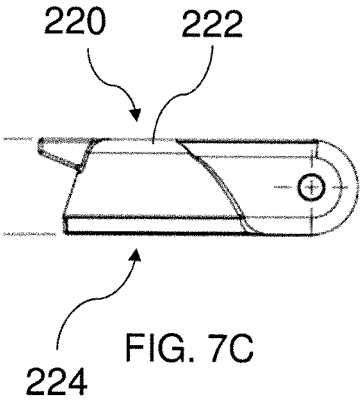
Figure 8A:
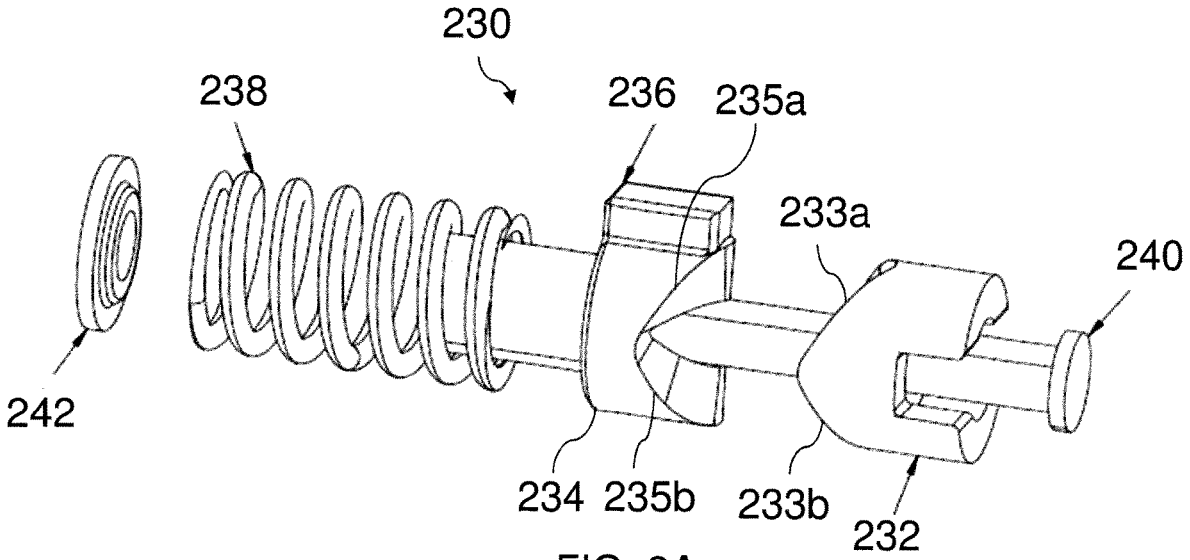
FIGS. 8A and 8B depict an exemplary hinge of the latch of FIGS. 2A and 2B.
Figure 8B:
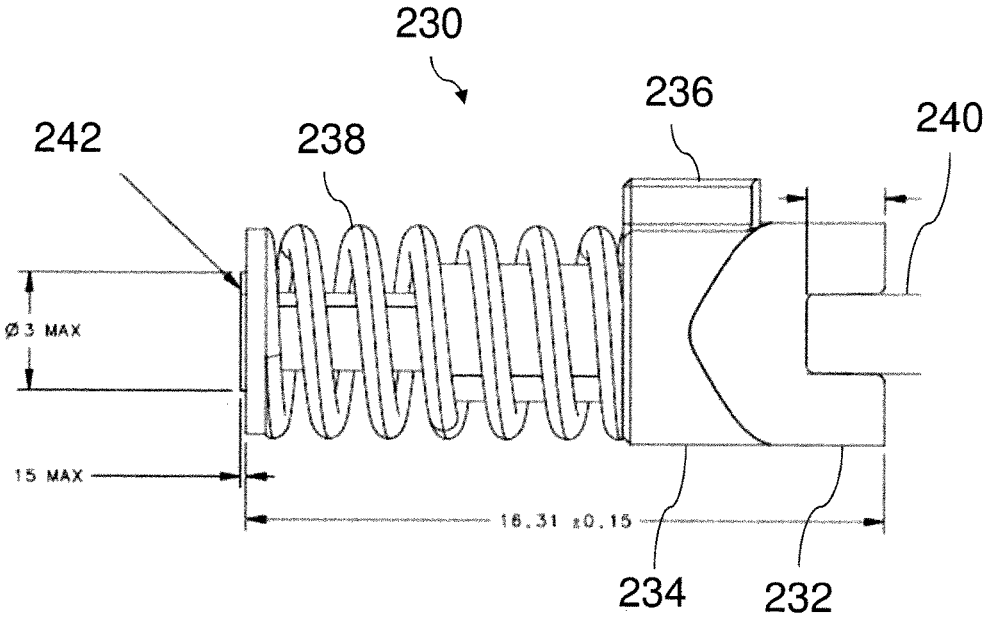
Figure 9C:
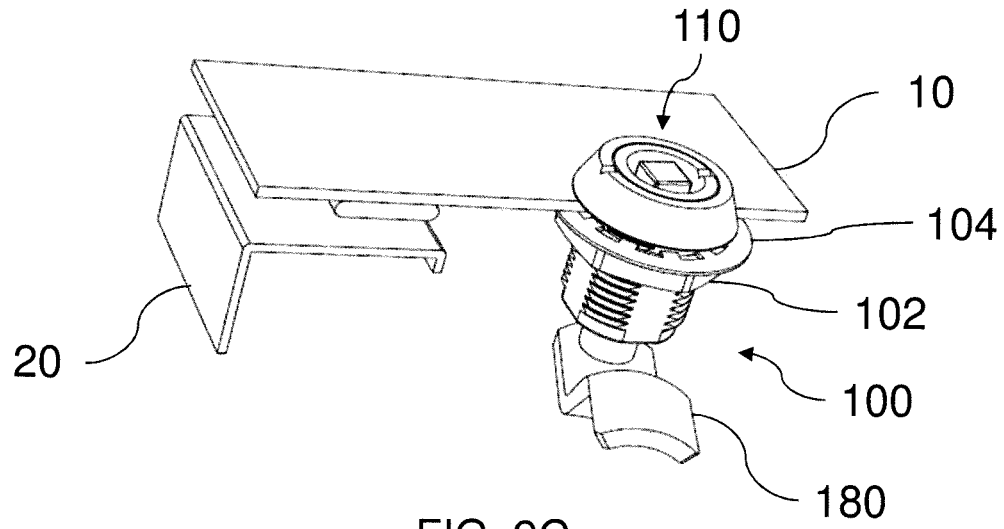
FIGS. 9A-9C depict an exemplary opening operation of the latch of FIG. 1 with a panel and frame.
Figure 9B:
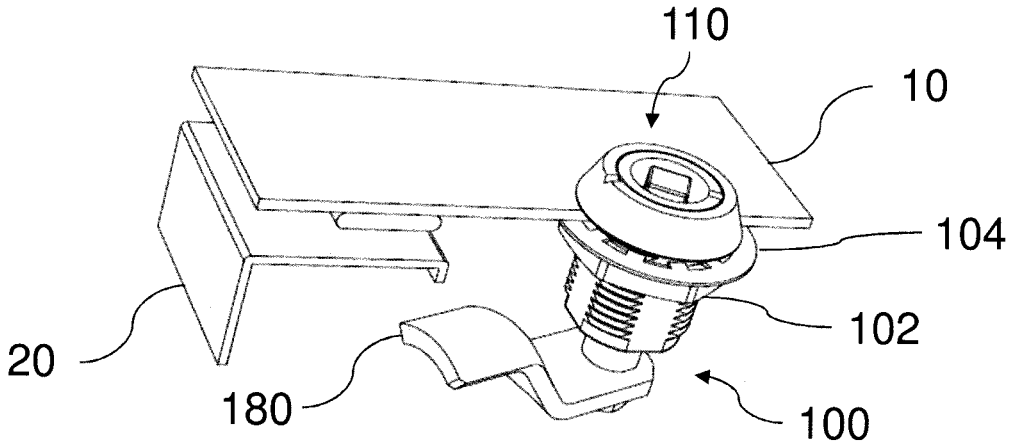
Figure 9A:
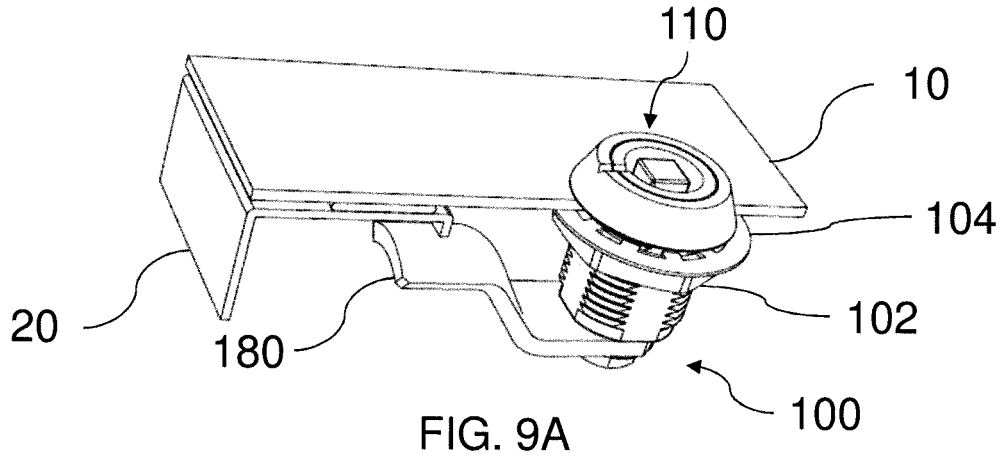

Referring now to the drawings, FIGS. 1-8B illustrate an exemplary latch 100 in accordance with aspects of the present invention. Latch 100 is configured to fix a panel 10 relative to a frame 20, as shown in FIGS. 9A-9C. As a general overview, latch 100 includes a housing 110, a cap 120, a shaft 130, a spring 140, a sleeve 150, a cam 160, pin 170, a pawl 180, and a cover 200. Additional details of latch 100 are described below.

Housing 110 houses the components of latch 100. Housing 110 is configured for engagement to panel 10. In an exemplary embodiment, housing 110 has a body portion 112 and a flanged portion 114 extending circumferentially around an outer surface of body portion 112, as shown in FIGS. 4A-4E. Body portion 112 is sized to fit within a through-hole in panel 10. Flanged portion 114 is sized to contact an inner or outer surface of panel 10 when body portion 112 of housing 110 is received within the through-hole.

In a preferred embodiment, housing 110 engages with panel 10 using a nut 102. Nut 102 is adapted to be screwed onto threading formed on the outer surface of body portion 112, such that panel 10 is clamped between flanged portion 114 and nut 102. A washer 104 may be added between panel 10 and nut 102 to create an appropriate securement of latch 100 to panel 10. Additionally, a gasket (not shown) may be added between panel 10 and the flanged portion 114 of the housing 110 to secure the interior of the compartment from external elements such as moisture or dust. The use of nut 102 within the compartment to secure latch 100 to panel 10 desirably prevents unauthorized removal of latch 100 from panel 10.

Alternatively or additionally, housing 110 may engage with panel 10 by any other means, including for example a frictional or threaded fit of body portion 112 within the through-hole of panel 10, or adhering the flanged portion 114 to the surface of panel 10. For example, a fastener such as a screw can be used as can bracket mounting configurations. Still further, a portion or all of housing 110 may be formed as an integral or unitary piece with panel 10.

Body portion 112 of housing 110 extends along a longitudinal axis. The longitudinal axis generally extends in a direction orthogonal to the plane of panel 10. Nonetheless, it will be understood from the description herein that the longitudinal axis may extend at an oblique angle relative to panel 10, and the direction of the longitudinal axis is not intended to be limited. Body portion 112 of housing 110 further defines an aperture 116 therein which extends along the longitudinal axis. Aperture 116 is sized to accommodate the components of latch 100, as described below.

Housing 110 may further include at least one indicator 118, as shown in FIGS. 4A-4E. Indicator 118 may be provided to indicate to a user the rotational location of the start or end point of the keyed components of the latch. In an exemplary embodiment, indicator 118 is a notch which, when aligned with a corresponding indicator on cap 120, indicates to the user that cap 120 is in the latched (or secured or locked) position. The latch is moveable from an unlatched position in which a panel is not latched relative to the frame, to a latched position in which the panel is latched relative to the frame. In the latched position, the panel may further be pulled against the frame such that they are compressed against one another.

Cap 120 is mounted at least partially within aperture 116 of housing 110. Cap 120 is not affixed to housing 110, so that it can rotate relative to housing 110 around the longitudinal axis. As shown in FIGS. 5A-5E, cap 120 may have a circular shape in order to enable unobstructed rotation of cap 120 within housing 110.

Cap 120 may be prevented from axial movement relative to housing 110. In an exemplary embodiment, cap 120 includes a retainer 119 which surrounds an outer surface of cap 120 and which engages within a corresponding groove formed along the inner circumferential surface of housing 110. In a preferred embodiment, a gasket 121 such as an O-ring may be added between housing 110 and cap 120 in order to secure the interior of body portion 112 from external elements such as moisture or dust. Cap 120 and/or housing 110 may include an annular groove or surface for accommodating gasket 121 between cap 120 and housing 110.

Cap 120 includes at least one drive surface 122, as shown in FIGS. 5A-5E. Drive surface 122 is accessible from a top of latch 100 when cap 120 is mounted within housing 110 and when cap 120 is uncovered, in order to enable a user to drive or rotate cap 120 relative to housing 110 between a latched position and an unlatched position, e.g., with a key. Drive surface 122 may be formed with a shape corresponding to a shape of a key (not shown). In this form, cap 120 cannot readily be rotated relative to housing 110 without the corresponding key for engaging with drive surface 122.

In one exemplary embodiment, cap 120 comprises a drive stud 126 extending from an upper surface of cap 120 along the longitudinal axis. Drive stud 126 may form the drive surface 122 for rotating cap 120. In an alternative or additional exemplary embodiment, cap 120 comprises a drive opening extending into an upper surface of cap 120 along the longitudinal axis. This drive opening may also form the drive surface 122 for rotating cap 120.

Cap 120 may further include at least one recess 124. Recess 124 is provided to enable closing of cover 200, as will be discussed in greater detail below. Recess 124 may also be provided to indicate to a user the rotational position of cap 120 relative to housing 110. In an exemplary embodiment, recess 124 is positioned to align with a corresponding indicator 118 on housing 110 to indicate to the user when cap 120 is in the latched (secured) position.

In an embodiment in which drive surface 122 of cap 120 is formed by drive stud 126, recess 124 may be defined in an upper surface or a wall of drive stud 126. Alternatively or additionally, in an embodiment in which drive surface 122 of cap 12 is formed by a drive opening, recess 124 may be defined in an upper surface or a wall of the drive opening.

Shaft 130 is mounted at least partially within aperture 116 of housing 110. Shaft 130 extends along the longitudinal axis of housing 110. Shaft 130 is mounted to be rotatable around the longitudinal axis relative to housing 110 and cap 120. Shaft 130 may have a circular shape in order to enable unobstructed rotation of shaft 130 within housing 110.

Shaft 130 is mounted to be axially movable relative to housing 110 and cap 120. In an exemplary embodiment, shaft 130 has a sliding engagement with cap 120 which defines the direction of the axial movement of shaft 130 relative to cap 120.

In an exemplary embodiment, shaft 130 includes a through-hole 134. Through-hole extends in the radial direction through the body of shaft 130. Through-hole 134 is shaped to accommodate a pin 170 passing through shaft 130, as described in further detail below.

Shaft 130 may further include threading 136 on a lower end thereof. Threading 136 is sized to accommodate a nut for affixing pawl 180, as described in further detail below.

Spring 140 is configured to bias shaft 130 away from cap 120 along the longitudinal axis. In an exemplary embodiment, spring 140 is a compression spring. The spring can include one or multiple elements, such as compression springs, wave springs, belleville washers, elastomeric springs, and/or conical springs. In an exemplary embodiment, spring 140 extends from a lower surface of cap 120 to a surface defined within a recess in a top of shaft 130, in order to reduce or further reduce the overall height of latch 100.

Sleeve 150 is positioned within aperture 116 interposed between housing 110 and shaft 130. Sleeve 150 thus defines an aperture in which shaft 130 is positioned.

Figure 6B:
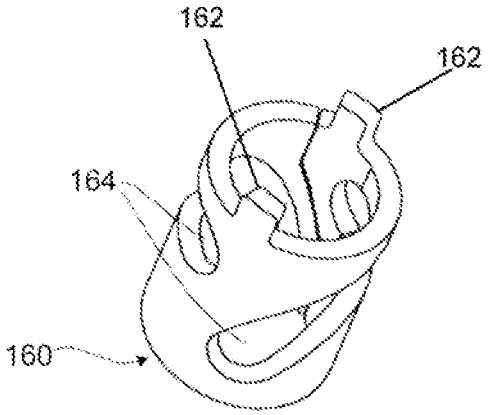
FIGS. 6A and 6B depict an exemplary cam and an exemplary sleeve, respectively, of the latch of FIG. 1.
Figure 6A:
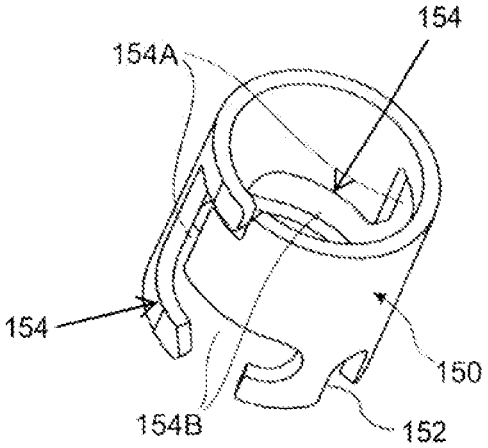

Sleeve 150 is mounted within housing 110 in such a manner to prevent rotation of sleeve 150 relative to housing 110. In an exemplary embodiment, as shown in FIG. 6A, sleeve 150 includes one or more keying features 152 positioned to mate with keying features 119 in housing 110. Keying features 152 and 119 may be detents, projections, recesses, or any other anti-rotation structures known to one of ordinary skill in the art from the description herein. Alternatively, all or a portion of sleeve 150 may be formed integrally or as a unitary piece with housing 110.

Sleeve 150 defines a pair of slots 154. Slots 154 are sized to receive pin 170 therein, and to allow axial and/or rotational movement of pin 170 along each slot 154. In an exemplary embodiment, each slot 154 has an L-shape, with a first portion 154A extending in the longitudinal or axial direction of housing 110, and a second portion 154B extending in the circumferential direction of housing 110. The first and second portions 154A, 154B of each slot 154 guide the movement of shaft 130 within housing 110 during an opening or closing operation of latch 100, as described in greater detail below.

Cam 160 is positioned within sleeve 150 interposed between sleeve 150 and shaft 130. Cam 160 is mounted within sleeve 150 to be rotatable relative sleeve 150 around the longitudinal axis. In particular, cam 160 is mounted to be rotatable with cap 120. In an exemplary embodiment, as shown in FIG. 6B, cam 160 includes one or more keying features 162 positioned to mate with keying features 128 in the lower surface of cap 120. Keying features 162 and 128 may be detents, projections, recesses, or any other anti-rotation structures known to one of ordinary skill in the art from the description herein.

Cam 160 defines a pair of slots 164. Slots 164 are sized to receive pin 170 therein, and to allow axial and/or circumferential movement of pin 170 along each slot 164. In an exemplary embodiment, each slot 164 is spirally curved around the outer circumferential surface of cam 160 between a first position near cap 120 and a second position axially spaced from the first position away from cap 120. With slots 154, slots 164 guide the movement of shaft 130 within housing 110 during an opening or closing operation of latch 100, as described in greater detail below.

While cam 160 is described as being positioned within sleeve 150, it will be understood that the invention is not so limited. Cam 160 could alternatively be positioned outside of sleeve 150, such that sleeve 150 is interposed between cam 160 and shaft 130, without departing from the scope of the invention.

Additionally, while cam 160 is described as being a separate component from cap 120, it will be understood that the invention is not so limited. Alternatively, all or a portion of cam 160 could be formed integrally or as a unitary piece with cap 120. Such a structure may be desired in order to further minimize the overall protrusion P of latch 100.

Pin 170 extends radially outward from shaft 130 relative to the longitudinal or axial direction of housing 110. Pin 170 is captured within an aperture formed in the shaft 130, and is received with slots 154 and 164. As a result, shaft 130 is limited to moving rotationally or axially within the path defined by the engagement of pin 170 with slots 154 and 164.

In an exemplary embodiment, pin 170 is a cylindrical post extending diametrically through through-hole 134 of shaft 130. The post has a length sufficient to form diametrically opposed projections on either side of shaft 130. In this embodiment, sleeve 150 and cam 160 may each include a pair of diametrically opposed slots 154 and 164 on either side thereof. Accordingly, while the operation of latch 100 is described herein with respect to a single slot 154, 164 and pin 170, it will be understood by one of ordinary skill in the art that one, two, or more respective slots and pins may be used without departing from the scope of the invention.

Pawl 180 is coupled indirectly to cap 120 to rotate with cap 120. In an exemplary embodiment, pawl 180 is fixedly coupled to the lower end of shaft 130 via one or more nuts that are engaged with threading 136 on either or both sides of pawl 180. Alternatively, pawl 180 may be fixedly coupled to the lower end of shaft 130 via a screw which engages with internal threading on shaft 130. A washer 184 may be added between the nut(s) and pawl 180 to create an appropriate securement of pawl 180 to shaft 130.

Pawl 180 is rotatable between a latched position and an unlatched position during rotation of cap 120. Pawl 180 is moved between the latched position and the unlatched positioned by rotation and axial movement of shaft 130 during rotation of cap 120.

Figure 1:
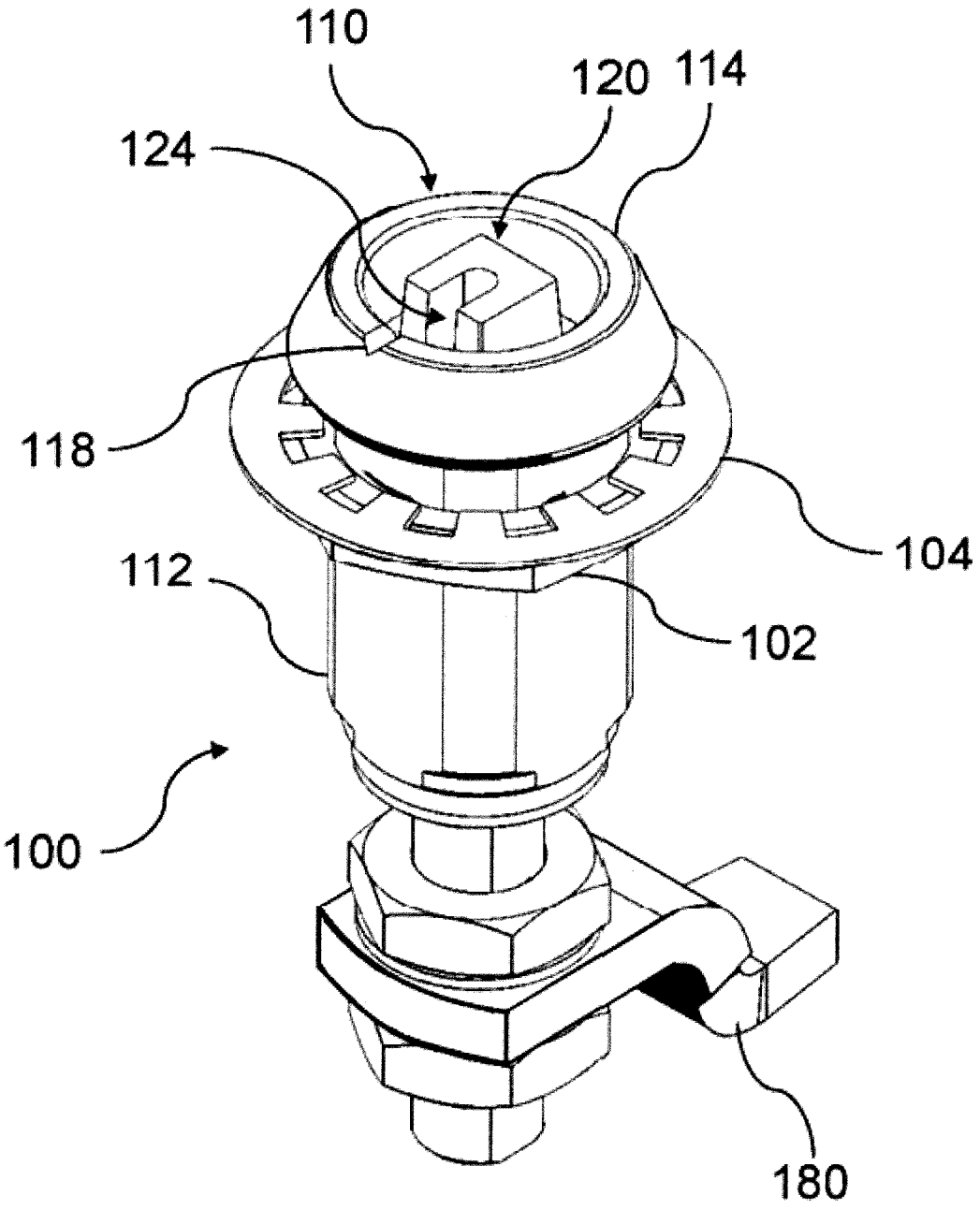
FIG. 1 depicts an exemplary latch configured to fix a panel relative to a frame in accordance with aspects of the present invention.
Figure 2A:
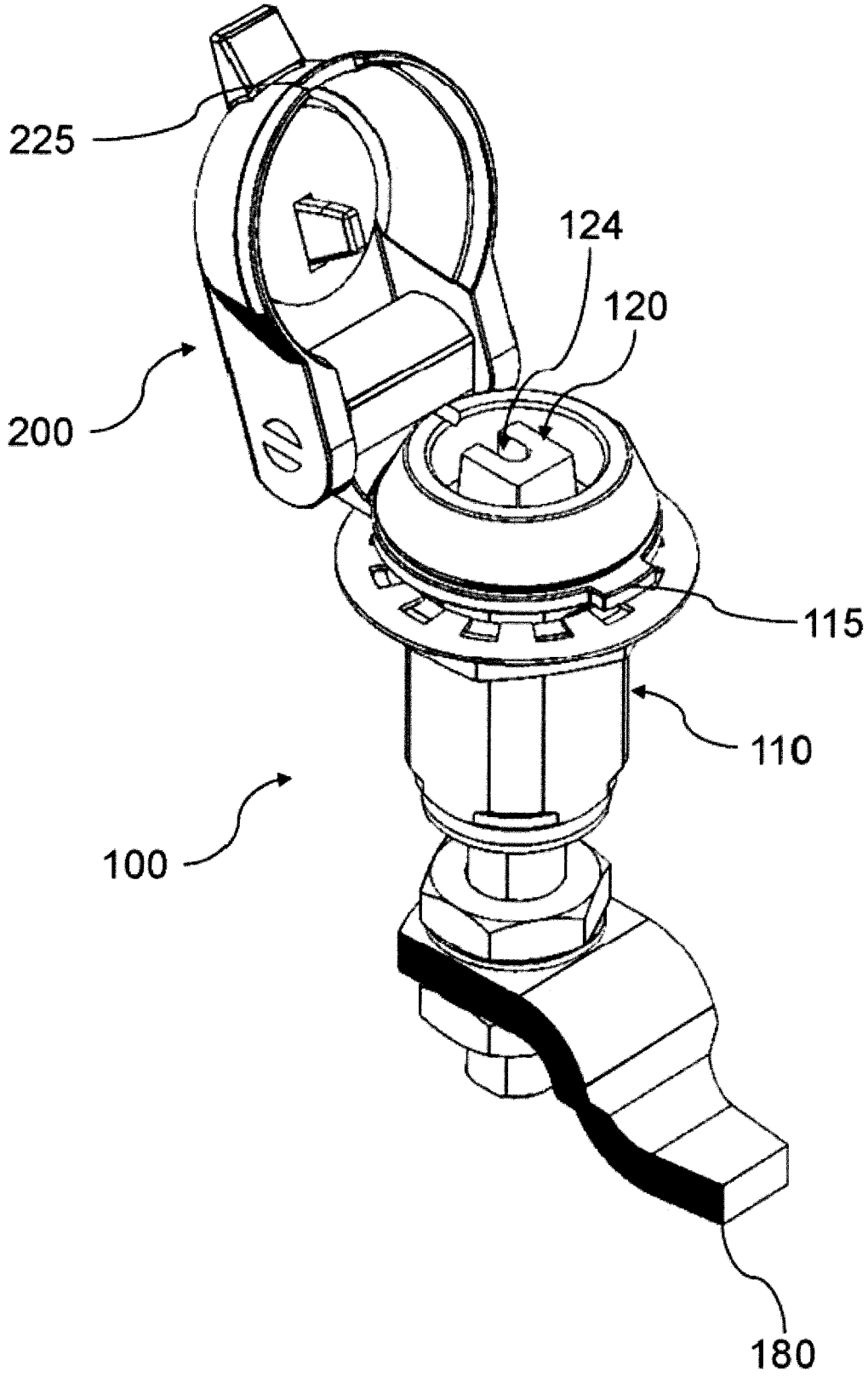
FIG. 2A depicts the latch of FIG. 1 having a cover in an open position.
Figure 2B:
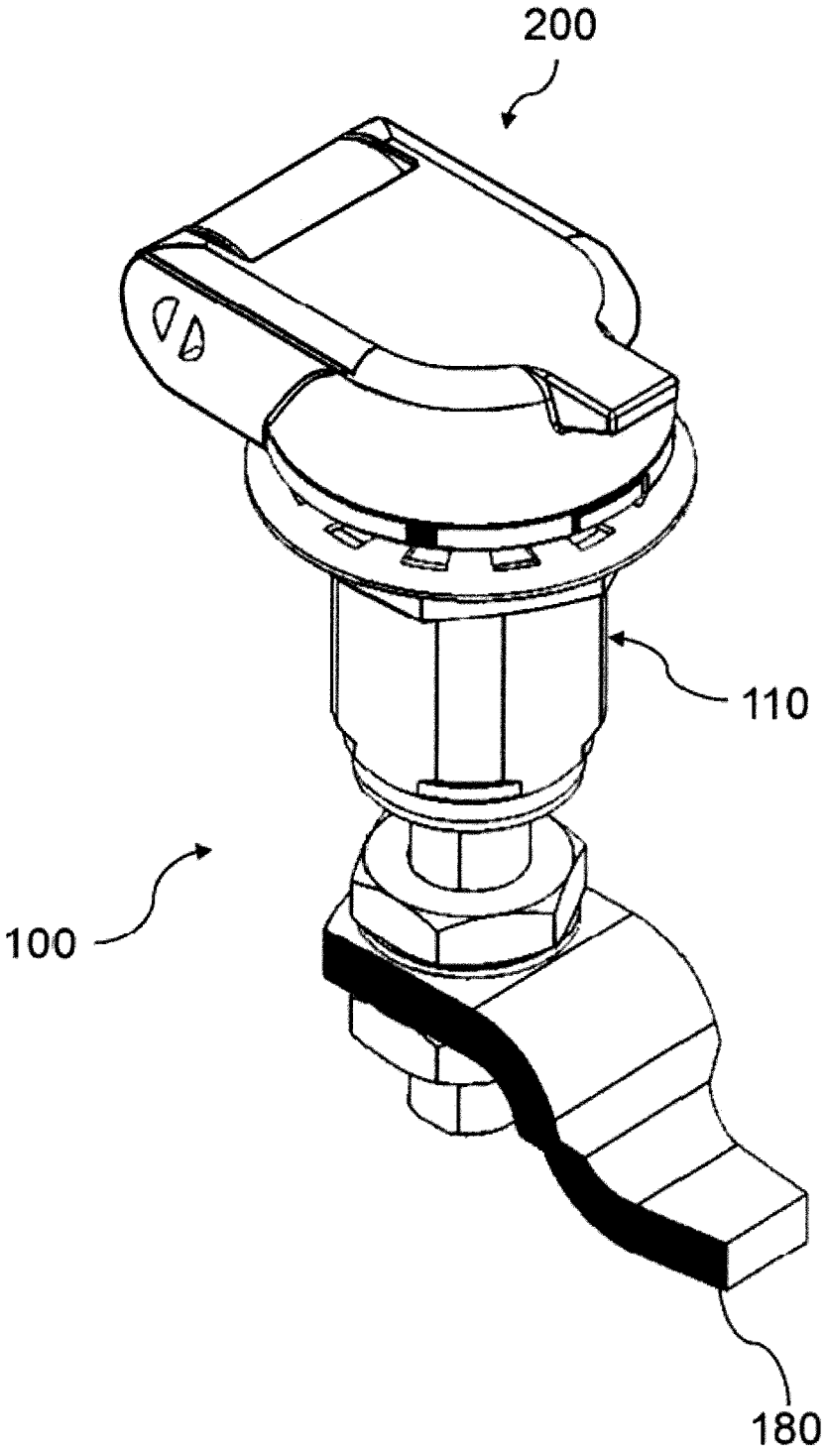
FIG. 2B depicts the latch of FIG. 1 having the cover in a closed position.
Figure 4B:
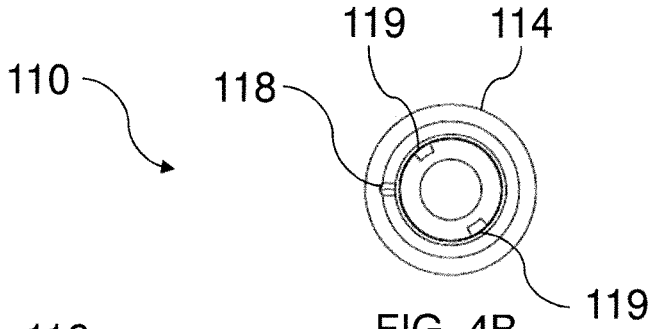
FIGS. 4A-4E depict an exemplary housing of the latch of FIG. 1.
Figure 4A:
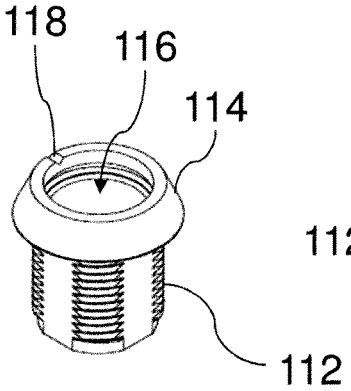
Figure 4C:
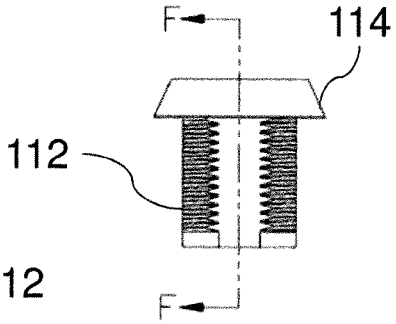
Figure 4E:
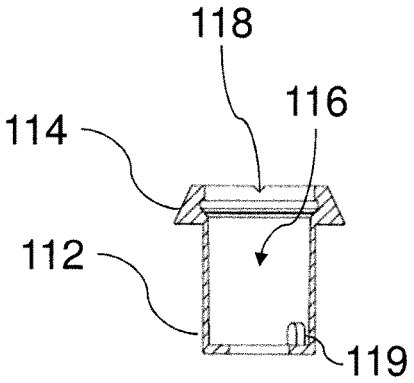
Figure 4D:
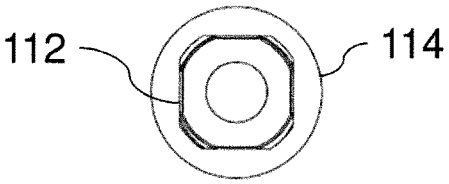
Figure 5B:
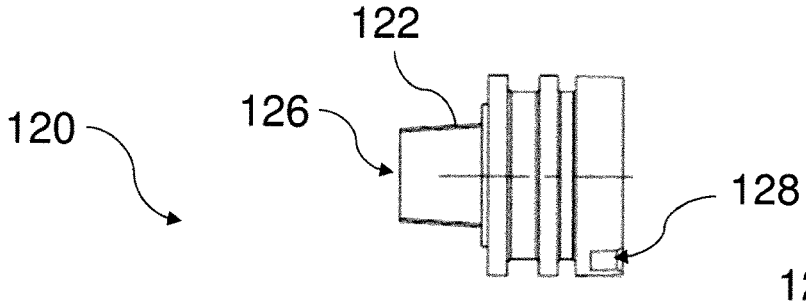
FIGS. 5A-5E depict an exemplary cap of the latch of FIG. 1.
Figure 5A:
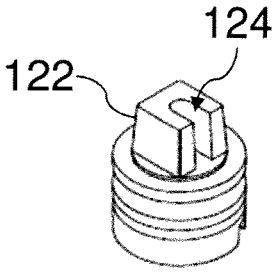
Figure 5C:
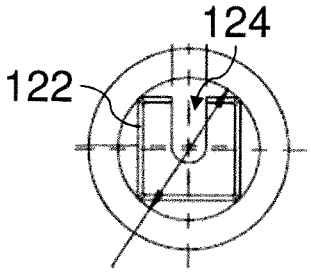
Figure 5E:
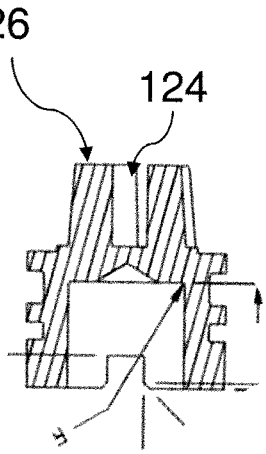
Figure 5D:
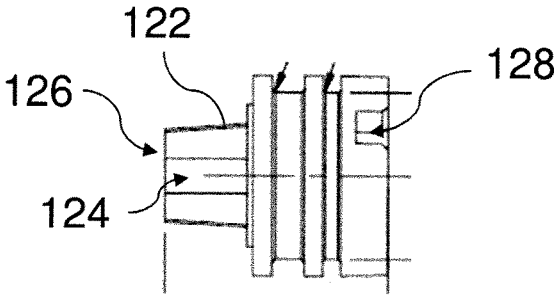

Cover 200 is coupled to housing 110. Cover 200 is configured to pivot about a lateral axis between an open position, as shown in FIG. 2A, and a closed position, as shown in FIG. 2B. As shown in FIG. 2A, in the open position, cover 200 does not cover cap 120, allowing access to cap 120 to perform a latching or unlatching operation. As shown in FIG. 2B, in the closed position, cover 200 covers cap 120, blocking access to cap 120. Cover 200 includes an engagement surface spaced from the lateral axis which aligns with a respective portion of cap 120 to allow pivoting of cover 200 to the closed position when cap 120 is in the latched position, as will be described in greater detail below.

In an exemplary embodiment, cover 200 includes a base 210, a lid 220, and a hinge 230. Base 210 is configured to be rigidly coupled to housing 110. As shown in FIGS. 2A and 2B, base 210 may be coupled to housing 110 below flanged portion 114. Base 210 includes a base portion 212 and an extending portion 214 which extends radially outward from base 210 in a radial direction of housing 110. As shown in FIGS. 7A-7C, extending portion 214 defines a lateral axis 216 around which lid 220 pivots.

While base 210 is described herein as a being a separate component from housing 110, it will be understood that the invention is not so limited. In other embodiments, base 210 could be integrally formed with housing 110, and/or the components of base 210 can be provided on the outer surface of housing 110.

Base 210 may also include a structure designed to mate with and/or hold lid 220 in place when cover 200 is in the closed position. In an exemplary embodiment, base 210 includes a detent 215 extending outwardly from base portion 212. Detent 215 may project outwardly from base portion 212 at a portion of base portion 212 opposite extending portion 214, as shown in FIG. 2A. In additional to or alternatively from being formed as part of base 210, detent 215 may be integrally formed within housing 110, or may be provided by a structure from both housing 110 and base 210.

Lid 220 is coupled to base 210. Lid 220 is coupled to pivot relative to base 210 about lateral axis 216. Lid 220 can pivot between the open position and the closed position in which lid 220 covers cap 120. As shown in FIGS. 7A and 7C, lid 220 has an upper surface 222 which faces away cap 120 when cover 200 is in the closed position, and a lower surface 224 which faces cap 120 when cover 200 is in the closed position.

When a detent 215 is provided, lid 220 may include a recess 225. Recess 225 is positioned to align with detent 215 when cover 200 is in the closed position. As shown in FIG. 2A, recess 225 is provided at an outer end of lid 220. Forming cover 200 with detent 215 and recess 225 may be useful to maintain alignment of lid 220 relative to base 210 when cover 200 is in the closed position, and to protect cover 200 against side impact when cover 200 is in the closed position.

An engagement surface 226 is provided on the lower surface 224 of lid 220. Engagement surface 226 may be spaced from lateral axis 216 of base 210 in order to better align with cap 120. Engagement surface 226 aligns with cap 120 when cap 120 is rotated to be in the latched position, to allow closing of cover 200. Engagement surface 226 may be spaced from lateral axis 216 of base 210 in order to better align with cap 120. In an exemplary embodiment, engagement surface 226 is defined by a protrusion extending from lower surface 224 toward cap 120.

A pad 228 may further be provided on the lower surface 224 of lid 220. Pad 228 may be provided to create an environmental seal for protecting internal features of latch 100 (such as cap 120, shaft 130, etc.) from moisture or dirt present in an external environment of latch 100. Pad 228 may also include one or more visual indicators to allow a user to easily see when lid 220 is in the open position. Such visual indicators may include, for example, bright colors, reflective surfaces, or other similar elements. Suitable materials for forming pad 228 will be known to one of ordinary skill from the description herein.

Hinge 230 couples lid 220 to base 210. Hinge 230 is provided along lateral axis 216. In one embodiment, hinge 230 may be a simple pin hinge which allows unbiased pivoting of lid 220 relative to base 210. In other embodiments, however, hinge 230 may provide unidirectional or bidirectional bias to lid 220 depending on the position of lid 220 relative to base 210. For example, a torsion spring may optionally be used to provide unidirectional biasing of hinge 230 in a predetermined direction.

In an exemplary embodiment of bidirectional bias, hinge 230 comprises a first cam 232 and a second cam 234. Cam 232 is fixed against rotation relative to lid 220, and cam 234 is fixed against rotation relative to base 210. In other words, cam 232 is rotationally fixed with lid 220, and cam 234 is rotationally fixed base 210. As shown in FIGS. 8A and 8B, cam 234 may include a keying feature 236 which enables cam 234 to be rotationally fixed with base 210.

Cams 232 and 234 are biased into contact with one another by spring 238. In a particular embodiment, spring 238 is a coil spring. As shown in FIGS. 8A and 8B, hinge 230 includes a pin 240 extending from a rear surface of cam 232, through cams 232 and 234, and beyond a rear surface of cam 234. Pin 240 is configured to be coupled to a washer 242 at an end thereof. Coil spring 238 is positioned to be compressed between the rear surface of cam 234 and washer 242 in order to bias cams 232 and 234 in contact with one another. Following assembly, washer 242 may be coupled to pin 240 by a separate pin 244, as shown in FIGS. 7A-7C.

While spring 238 is shown pressing against a rear surface of cam 234, it will be understood that this orientation is not intended to be limiting. In other embodiments, spring 238 may instead press cam 232 against 234 without departing from the scope of the present invention. Additionally, while spring 238 is shown as a coil spring, other springs suitable for use as spring 238 will be known to one of ordinary skill in the art from the description herein.

As set forth above, hinge 230 may provide bidirectional bias to lid 220 depending on the position of lid 220 relative to base 210. In one such embodiment, cam 232 includes first and second cam surfaces 233*a* and 233*b*, and cam 234 includes first and second cam surfaces 235*a* and 235*b*. Contact between cam surfaces 233*a* and 235*a* generated by spring 238 may bias lid 220 to rotate in a direction toward the closed position, and contact between cam surfaces 233*b* and 235*b* generated by spring 238 may bias lid 220 to rotate in a direction toward the open position.

An exemplary operation of latch 100 is described below with respect to FIGS. 9A-9C. FIG. 9A shows latch 100 in the closed position. As shown in FIG. 9A, pawl 180 is rotated to engage with frame 20 in the latched position. At this stage, in order to open latch 100, a user engages a key (not shown) with cap 120 and begins rotating. Rotating cap 120 causes a corresponding rotation of cam 160, e.g., due to keying features 162 and 128. As cam 160 rotates, the spiral slot 164 of cam 160 applies a force to pin 170 in an axial and circumferential direction. The first portion of the L-shaped slot 154 allows movement of pin 170 in the axial direction, and prevents movement of pin 170 in the circumferential direction. As a result, rotation of cap 120 and cam 160 from the closed position causes pin 170, and correspondingly shaft 130, to move only in the axial direction away from cap 120 (under bias from spring 140). This axial movement of shaft 130 moves pawl 180 axially downward and away from frame 20. The axial movement of pin 170 proceeds until pin 170 reaches the second portion of L-shaped slot 154.

FIG. 9B shows latch 100 in a position between the opened and closed positions, after pin 170 reaches the second portion of L-shaped slot 154. As cam 160 continues to rotate, the spiral slot 164 of cam 160 continues to apply a force to pin 170 in an axial and circumferential direction. The second portion of the L-shaped slot 154 prevents further movement of pin 170 in the axial direction, but allows movement of pin 170 in the circumferential direction. As a result, continued rotation of cap 120 and cam 160 causes pin 170, and correspondingly shaft 130, to move only in the rotational or circumferential direction. This rotational movement of shaft 130 moves pawl 180 rotationally away from frame 20. As shown in FIG. 9B, pawl 180 has begun to rotate away from frame 20 toward the open position.

FIG. 9C shows latch 100 in an open position, after pin 170 reaches the end of the second portion of L-shaped slot 154. Rotation of cap 120 and cam 160 may be continued until pin 170 reaches the end of slot 154, and no more rotational movement of pin 170 of shaft 130 is possible. As shown in FIG. 9C, pawl 180 has been fully rotated, and cannot engage frame 20. It will be understood that the rotational distance between the fully open and closed position may be any desired distance.

While the exemplary embodiment in FIGS. 9A-9C (and elsewhere herein) depict a counterclockwise rotation of the cap from the closed position to the open position, it will be understood that the operations described herein may alternatively be performed with a clockwise rotation of the cap.

Figure 10A:
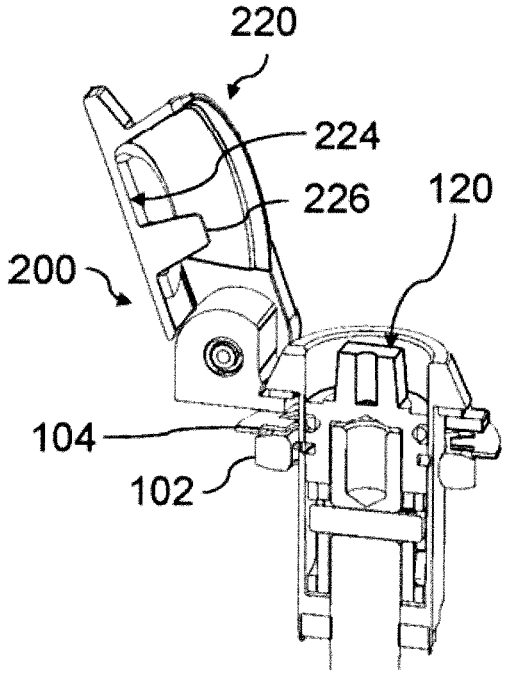
FIGS. 10A-10C depict an exemplary closing operation of the cover of the latch of FIGS. 2A and 2B when the latch is in an unlatched position.
Figure 10B:
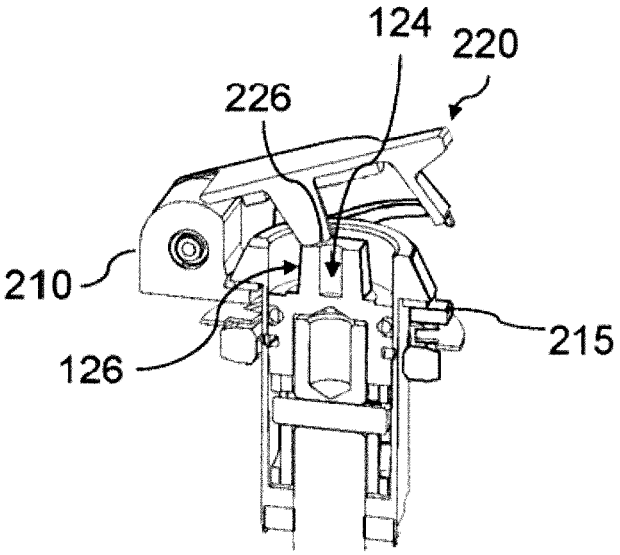
Figure 10C:
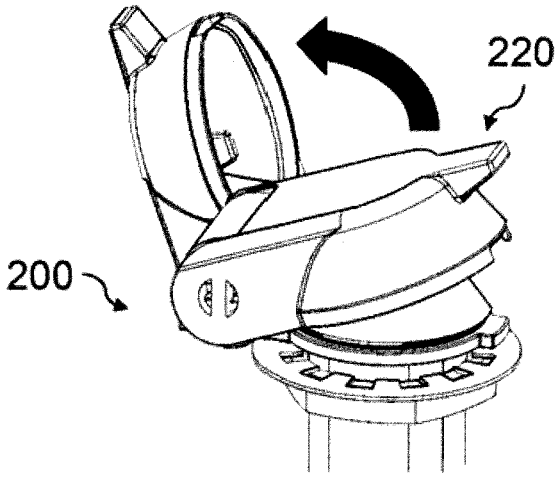

An exemplary closing operation of cover 200 of latch 100 is described below with respect to FIGS. 10A-10C. In the closing operation of FIGS. 10A-10C, cap 120 is in the unlatched position, e.g., is rotated to a position in which pawl 180 does not fully engage with frame 20. Cover 200 is shown in FIG. 10A in an open position.

When cap 120 is in the unlatched position, the drive surface 122 of cap 120 is aligned with the pivoting movement of the engagement surface 226 of cover 200, and thereby is positioned to block cover 200 from pivoting to the closed position. As shown in FIG. 10B, recess 124 in drive stud 126 is unaligned with the protrusion which defines engagement surface 226 on the underside of lid 220, and thereby drive stud 126 is positioned to block lid 220 from pivoting to the closed position.

As set forth above, hinge 230 may provide bidirectional bias. In an exemplary embodiment, cam surfaces 233*a* and 235*a* contact each other up until the point at which the protrusion defining engagement surface 226 enters recess 124 of cap 120, at which point cam surfaces 233*b* and 235*b* contact one another. Accordingly, as long as cover 200 is blocked from being pivoted to a position at which the protrusion enters recess 124 of cap 120, cams 232 and 234 of hinge 230 bias lid 220 to move toward the open position of cover 200, as shown by arrow in FIG. 10C.

Figure 11A:
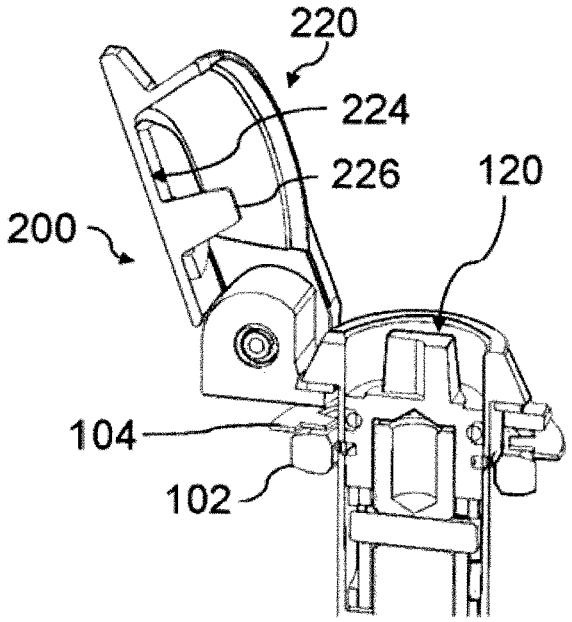
FIGS. 11A-11C depict an exemplary closing operation of the cover of the latch of FIGS. 2A and 2B when the latch is in a latched position.
Figure 11B:
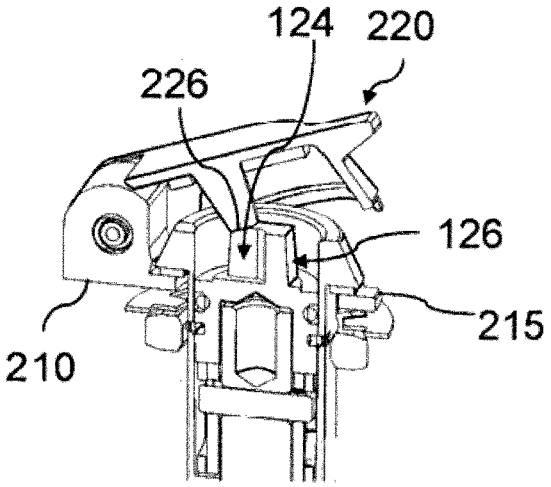

Another exemplary closing operation of cover 200 of latch 100 is described below with respect to FIGS. 11A-11C. In the closing operation of FIGS. 11A-11C, cap 120 is in the latched position, e.g., is rotated to a position in which pawl 180 fully engages with frame 20. Cover 200 is shown in FIG. 11A in an open position.

Figure 11C:
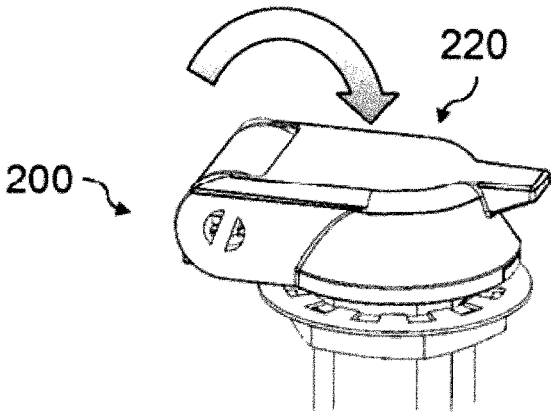

When cap 120 is in the latched position, the drive surface 122 of cap 120 is unaligned with the pivoting movement of the engagement surface 226 of cover 200, and thereby is positioned to permit cover 200 to pivot to the closed position shown in FIG. 11C. As shown in FIG. 11B, recess 124 in drive stud 126 is aligned with the protrusion which defines engagement surface 226 on the underside of lid 220, and thereby drive stud 126 is positioned to permit lid 220 to pivot to the closed position.

As explained above, cam surfaces 233*a* and 235*a* may contact each other up until the point at which the protrusion defining engagement surface 226 enters recess 124 of cap 120, at which point cam surfaces 233*b* and 235*b* contact one another. Accordingly, as soon as cover 200 is pivoted to a position at which the protrusion enters recess 124 of cap 120, cams 232 and 234 of hinge 230 bias lid 220 to move toward the closed position, as shown by arrow in FIG. 11C. By biasing lid 220 to move toward the closed position, cams 232 and 234 may assist in creating an environmental seal of the interior components of latch 100 against moisture and dust in an external environment.

Figure 12:
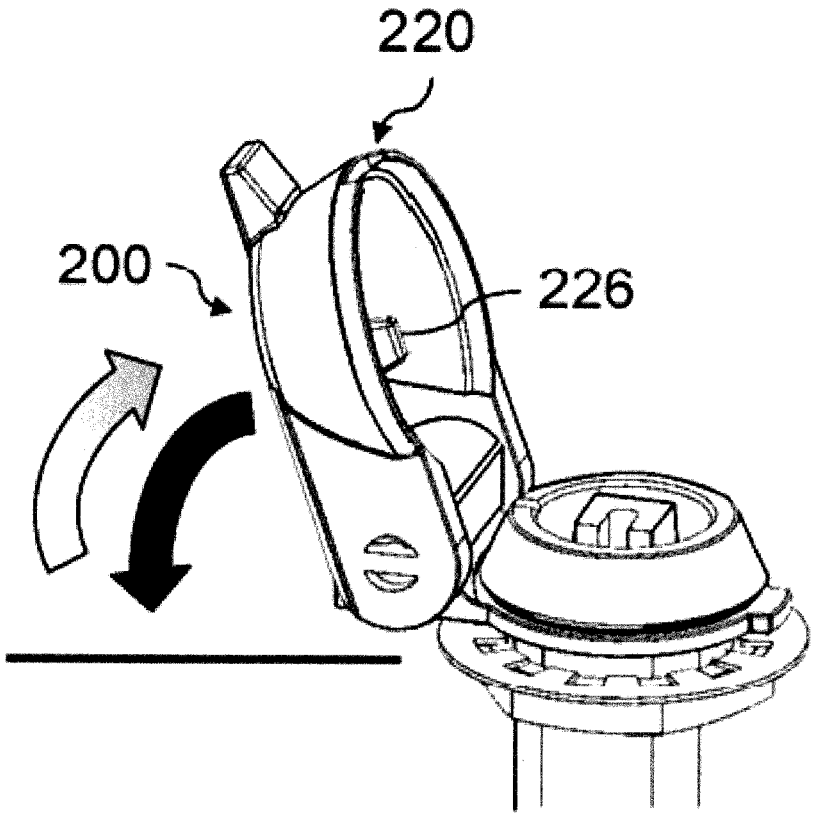
FIG. 12 depicts an exemplary opening operation of the cover of the latch of FIGS. 2A and 2B.

The bidirectional bias provided by hinge 230 may not be limited to being provided between the open and closed positions of lid 220. As shown by arrows in FIG. 12, lid 220 may be pivoted to a position beyond the open position of cover 200. In an exemplary embodiment, during pivoting of cover 200 from the closed position to the open position, cam surfaces 233*a* and 235*a* contact each other up until the point at which lid 220 reaches the open position, at which point cam surfaces 233*b* and 235*b* contact one another. Accordingly, once lid 220 is pivoted to a position beyond the open position of cover 200, cams 232 and 234 of hinge 230 bias lid 220 to move back toward the open position of cover 200, as shown by arrow in FIG. 12.

Figure 13:
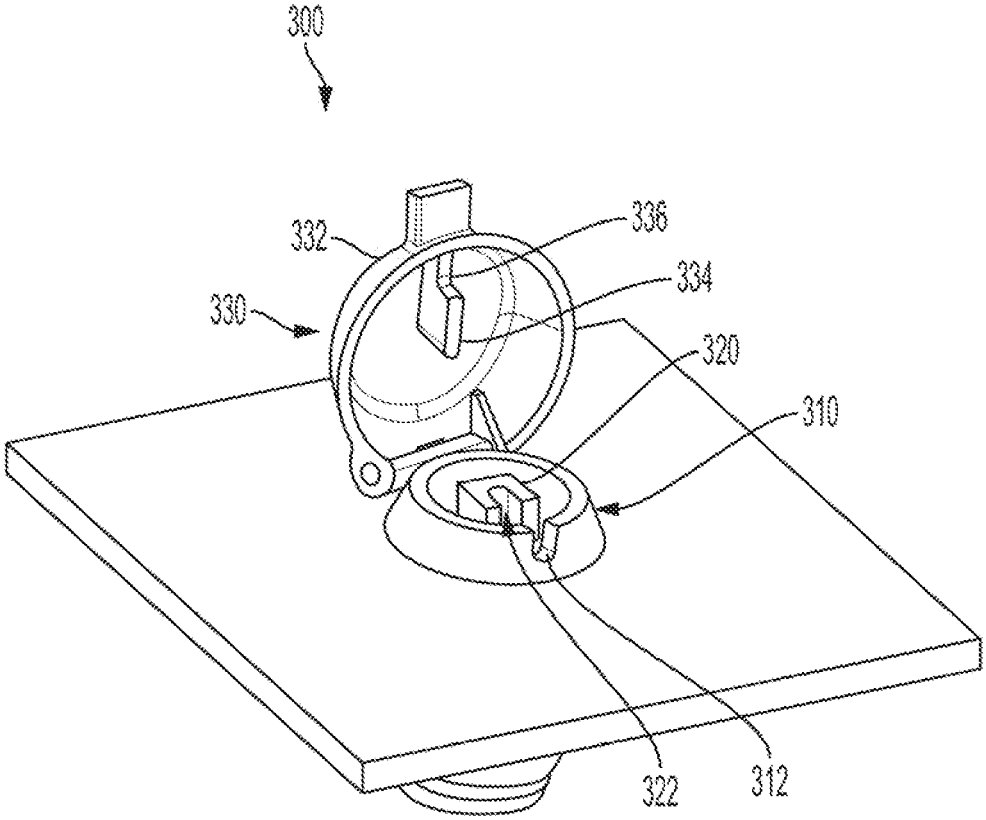
FIG. 13 depicts another exemplary latch configured to fix a panel relative to a frame in accordance with aspects of the present invention and having a cover in an open position.

FIG. 13 depicts another exemplary latch 300 in accordance with aspects of the present invention. Latch 300 may include substantially the same components as latch 100 except as expressly set forth below.

As shown in FIG. 13, latch 300 includes a housing 310 which is received in a panel. A cap 320 is rotatably mounted within an aperture in housing 310. A cover 330 is coupled to housing 310. Cover 330 includes a lid 332 which is configured to pivot about a lateral axis between an open position, as shown in FIG. 13, and a closed position. In the open position, cover 330 does not cover cap 320, allowing access to cap 320 to perform a latching or unlatching operation of latch 300.

A recess 322 is provided in a drive surface of cap 320, and an engagement surface 334 is provided on a lower surface of lid 332. As shown in FIG. 13, engagement surface 334 is defined by a protrusion extending from the lower surface of lid 332 toward cap 320. When cap 320 is in the unlatched position, recess 322 is unaligned with engagement surface 334, and thereby the drive surface of cap 320 is positioned to block lid 332 from pivoting to the closed position. When cap 320 is in the latched position, recess 322 is aligned with engagement surface 334, and the drive surface of cap 320 is positioned to allow lid 332 to pivot to the closed position.

In addition to engaging with cap 320, cover 330 may also engage with housing 310. A recess 312 is provided in housing 310. As shown in FIG. 13, recess 312 may extend from an upper surface of housing 310. Likewise, an engagement surface 336 is provided on a lower surface of lid 332. As shown in FIG. 13, engagement surface 334 is defined by a protrusion extending from the lower surface of lid 332 toward cap 320. The protrusion defining engagement surface 336 may be continuous with or separate from the protrusion defining engagement surface 334. Likewise, the protrusion defining engagement surface 336 may have a same or different height as the protrusion defining engagement surface 334. Recess 312 is aligned with engagement surface 336, and the protrusion defining engagement surface 336 engages with recess 312 when lid 332 is pivoted to the closed position.

Providing multiple engagement surfaces 334 and 336 may be useful to accomplish multiple purposes including preventing closing of cover 330 when cap 320 is in the unlatched position, as well as preventing rotation of cover 330 relative to cap 320 or housing 310 when cover 330 is in the closed position.

Figure 14:
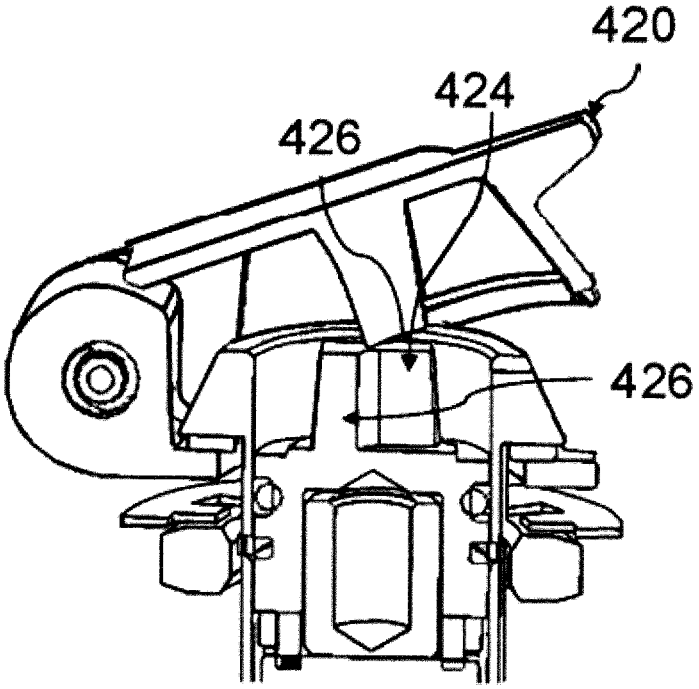
FIG. 14 depicts another exemplary latch configured to fix a panel relative to a frame in accordance with aspects of the present invention.

FIG. 14 depicts another exemplary latch configured to fix a panel relative to a frame in accordance with aspects of the present invention. The embodiment illustrated in FIG. 14 is similar to the embodiment illustrated in FIG. 11B except that the recess in the drive stud is positioned at a location opposite the hinge. In other words, the engagement surface 426 on the underside of lid 420 in this embodiment is positioned a greater distance away from the hinge, and the recess 424 in drive stud 426 is located on the opposite side of the drive stud 426 as compared to the recess in FIG. 11B. As shown in FIG. 14, recess 424 in drive stud 426 is aligned with the protrusion which defines engagement surface 426 on the underside of lid 420, and thereby drive stud 426 is positioned to permit lid 420 to pivot to the closed position.

While preferred embodiments of the invention have been shown and described herein, it will be understood that such embodiments are provided by way of example only. Numerous variations, changes and substitutions will occur to those skilled in the art without departing from the spirit of the invention. Accordingly, it is intended that the appended claims cover all such variations as fall within the spirit and scope of the invention.

What is claimed:

1. A latch configured to fix a panel relative to a frame, the latch comprising:

a housing configured for engagement to the panel, the housing having a longitudinal axis and defining an aperture along the longitudinal axis;

a cap mounted within the aperture of the housing for rotation about the longitudinal axis, the cap comprising a drive surface for rotating the cap relative to the housing between a latched position and an unlatched position; and a cover coupled to the housing to pivot about a lateral axis different from the longitudinal axis, the cover pivotable to be in a closed position in which the cover covers the cap, the cover comprising an engagement surface spaced from the lateral axis;

wherein when the cap is in the unlatched position, the drive surface of the cap is aligned with the engagement surface of the cover and positioned to block the cover from pivoting to the closed position;

wherein when the cap is in the latched position, the drive surface of the cap is unaligned with the engagement surface of the cover and positioned to permit the cover to pivot to the closed position; and wherein the cap comprises a drive stud extending along the longitudinal axis and forming the drive surface, the drive surface comprising a recess defined in the drive stud.

2. The latch of claim 1, wherein the cap defines a drive opening extending in a direction along the longitudinal axis and forming at least a portion of the drive surface.

3. The latch of claim 2, wherein the drive surface comprises a recess defined in a wall of the drive opening.

4. The latch of claim 1, wherein the engagement surface is defined by a protrusion extending from a surface of the cover facing the cap when the cover is in the closed position.

5. The latch of claim 1, further comprising a hinge extending along the lateral axis.

6. The latch of claim 5, wherein the hinge comprises a first cam fixed against rotation relative to the housing, a second cam fixed against rotation relative to the cover, and a spring biasing the first and second cams to contact one another.

7. The latch of claim 6, wherein the first and second cams each comprise first and second cam surfaces, wherein contact between the first cam surfaces generated by the spring biases the cover to rotate in a direction toward the closed position, and wherein contact between the second cam surfaces generated by the spring causes the cover to rotate in a direction away from the closed position.

8. The latch of claim 1, further comprising:

a pawl coupled to the cap, the pawl being configured to engage the frame.

9. The latch of claim 8, further comprising:

a shaft extending along the longitudinal axis within the aperture of the housing, the shaft being mounted for rotation about the longitudinal axis, the shaft further being mounted for axial movement relative to the cap;

a spring configured to bias the shaft away from the cap along the longitudinal axis;

a sleeve interposed between the shaft and the housing, the sleeve defining a first slot;

a cam interposed between the shaft and the housing, the cam being rotatable relative to the sleeve about the longitudinal axis, the cam defining a second slot; and a pin extending radially outwardly from the shaft relative to the longitudinal axis, the pin extending into the first and second slots, wherein the first and second slots are configured to guide the rotation and axial movement of the shaft as the cap is rotated within the housing such that the pawl engages or disengages the frame.

10. The latch of claim 1 further comprising a base rigidly coupled to the housing; and a hinge extending along the lateral axis and coupling the cover to the base, the hinge comprising a first cam fixed against rotation relative to the base, a second cam fixed against rotation relative to the cover, and a spring biasing the first and second cams to contact one another.

11. The latch of claim 10, wherein the first and second cams each comprise first and second cam surfaces, wherein contact between the first cam surfaces generated by the spring biases the cover to rotate in a direction toward the closed position, and wherein contact between the second cam surfaces generated by the spring causes the cover to rotate in a direction away from the closed position.

12. A compartment comprising:

a frame;

a panel mounted for movement relative to the frame between opened and closed positions; and the latch of claim 1 coupled to the panel, the latch being positioned to fix the panel relative to the frame in the closed position.

13. The latch of claim 1, wherein the housing defines a recess extending radially outwardly from the longitudinal axis of the housing and the cover includes a housing engagement surface positioned to extend into the recess when the cover is in the closed position.

14. The latch of claim 13, wherein the housing engagement surface extends from the engagement surface.

15. The latch of claim 13, wherein the engagement surface and the housing engagement surface inhibit relative rotation of the cap and the housing when the cover is in the closed position.

16. The latch of claim 1, further comprising a base fixed against rotation relative to the housing, the cover being pivotally connected to the base.

17. The latch of claim 16, further comprising a recess defined on the cover or on the base for engagement with a protrusion on the base or on the cover, the recess and the protrusion being positioned to resist rotation of the cover relative to the housing when the cover is in the closed position.

18. The latch of claim 17, wherein the recess is defined on the cover and the protrusion is on the base.

19. The latch of claim 1, wherein the drive stud is configured to be operated with a key for rotating the drive stud between the latched position and the unlatched position.

* * * * *